US011205862B2

(12) United States Patent
Randolph et al.

(10) Patent No.: US 11,205,862 B2
(45) Date of Patent: Dec. 21, 2021

(54) INSULATION DISPLACEMENT CONTACT WITH EXPANDED WIRE RANGE CAPACITY

(71) Applicant: TE CONNECTIVITY SERVICES GmbH, Schaffhausen (CH)

(72) Inventors: Kurt Allan Randolph, Etters, PA (US); Brian Keith Weaver, Harrisburg, PA (US)

(73) Assignee: TE CONNECTIVITY SERVICES GMBH, Schaffhausen (CH)

( * ) Notice: Subject to any disclaimer, the term of this patent is extended or adjusted under 35 U.S.C. 154(b) by 114 days.

(21) Appl. No.: 16/665,672

(22) Filed: Oct. 28, 2019

(65) Prior Publication Data

US 2021/0126382 A1 Apr. 29, 2021

(51) Int. Cl.
*H01R 4/2462* (2018.01)
*H01R 4/245* (2018.01)
*H01R 4/2429* (2018.01)

(52) U.S. Cl.
CPC ..... *H01R 4/2462* (2013.01); *H01R 4/245* (2013.01); *H01R 4/2429* (2013.01)

(58) Field of Classification Search
CPC ..... H01R 4/24; H01R 4/2462; H01R 4/2466; H01R 4/245; H01R 4/2454; H01R 4/2455; H01R 4/2456; H01R 4/2429; H01R 13/58; H01R 13/64; H01R 13/113
See application file for complete search history.

(56) References Cited

U.S. PATENT DOCUMENTS 4,317,608 A * 3/1982 Dechelette ..... H01R 4/2462 439/403
4,548,459 A * 10/1985 Mosser, III ..... H01R 4/2462 439/395

(Continued)

FOREIGN PATENT DOCUMENTS

DE 4225078 A1 2/1994
EP 0660441 A1 6/1995

(Continued)

OTHER PUBLICATIONS

AMP Catalog: Magnet Wire Terminals (AMPLIVAR and MAG-MATE) p. 27, Apr. 1995.

*Primary Examiner* — Edwin A. Leon
*Assistant Examiner* — Milagros Jeancharles
(74) *Attorney, Agent, or Firm* — Saxton & Stump LLC

(57) ABSTRACT

An insulation displacement arms. The insulation displacement arms define a conductor or wire receiving slot. The insulation displacement arms have insulation stripping sections, weakened sections and base sections. The weakened sections have weakened section widths which are less than insulation stripping section widths of the insulation stripping sections and less than base section widths of the base section. The weakened sections are resiliently deformed upon one or more insulated conductors engaging the insulation stripping sections of the insulation displacement arms as the one or more insulated conductors are inserted into the insulation stripping zone of the wire receiving slot, allowing the insulation displacement contact to accommodate the one or more insulated conductors of the same type and gauge chosen from a broad range of gauges.

20 Claims, 6 Drawing Sheets

(56) References Cited

U.S. PATENT DOCUMENTS

| | | | | | |
|---|---|---|---|---|---|
| 4,580,870 | A * | 4/1986 | Gerke | H01R 4/2425 | 439/816 |
| 5,073,126 | A * | 12/1991 | Kikuchi | H01R 4/245 | 439/452 |
| 5,827,087 | A * | 10/1998 | Yamasaki | H01R 4/2425 | 439/395 |
| 7,118,404 | B2 * | 10/2006 | Ploesser | H01R 4/2454 | 439/398 |
| 8,083,538 | B2 | 12/2011 | Ofenloch et al. | | |
| 2014/0015357 | A1 * | 1/2014 | Randolph | H01R 4/2454 | 310/71 |

FOREIGN PATENT DOCUMENTS

| | | |
|---|---|---|
| EP | 9856912 | 1/1997 |
| WO | 9745894 | 12/1997 |

* cited by examiner

INSULATION DISPLACEMENT CONTACT WITH EXPANDED WIRE RANGE CAPACITY

FIELD OF THE INVENTION

The present invention relates to an insulation displacement contact with expanded wire range capacity. In particular, the invention relates to an insulation displacement contact which can terminate one or more magnet wires of the same type and size therein, and the magnet wire size can be from a large range of available sizes.

BACKGROUND OF THE INVENTION

As the number of electrical appliances increases, the need to manufacture and assemble small electrical motors in an efficient manner greatly increases. The motors are typically incorporated into appliances such as vacuum cleaners, kitchen appliances, and any other power accessory used in home or business. One electrical contact that is particularly useful for automated assembly is TE Connectivity's Mag-Mate Interconnection System. Contacts of this type enable insulation displacement-style contact techniques to be applied to magnet wire terminations, thereby eliminating the need for pre-stripping the magnet wire.

While the insulation displacement-style contact techniques applied to magnet wire terminations are effective in many applications, there exists a need to provide a magnet wire insulation displacement contact which can effectively terminal magnet wires of different gauges and/or more than one magnet wire.

It would, therefore, be beneficial to provide a magnet wire insulation displacement contact which is configured to allow for the termination of more than one magnet wire of the same type and gauge therein and to allow for the termination of a broad range of gauges.

SUMMARY OF THE INVENTION

An embodiment is directed to an insulation displacement contact with insulation displacement arms. The insulation displacement arms define a conductor or wire receiving slot. The insulation displacement arms have insulation peeling or stripping sections, weakened sections and base sections. The weakened sections have weakened section widths which are less than insulation stripping section widths of the insulation stripping sections and less than base section widths of the base section. The wire receiving slot is configured to receive one or more insulated conductors therein. The wire receiving slot has an insulation stripping zone and a wire termination zone. The insulation stripping zone is adjacent to the insulation stripping sections of the insulation displacement arms. The wire termination zone is adjacent to the weakened sections of the insulation displacement arms. The insulation stripping zone width of the insulation stripping zone is greater than the wire termination zone width of the wire termination zone. The weakened sections are resiliently deformed upon the one or more insulated conductors engaging the insulation stripping sections of the insulation displacement arms as the one or two insulated conductors are inserted into the insulation stripping zone of the wire receiving slot, allowing the insulation displacement contact to accommodate the one or more insulated conductors of different gauges.

An embodiment is directed to an insulation displacement contact with insulation displacement arms which define a conductor or wire receiving slot. The insulation displacement arms have insulation stripping sections, weakened sections and base sections. The wire receiving slot is configured to receive one or more insulated conductors therein. The wire receiving slot has an insulation stripping zone and a wire termination zone. The insulation stripping zone is adjacent to the insulation stripping sections of the insulation displacement arms. The wire termination zone is adjacent to the weakened sections of the insulation displacement arms. Relief slots are provided proximate the weakened sections of the insulation displacement arms. The slots extend from sides of the weakened sections which are opposite the wire receiving slot. The relief slots reduce width of the weakened sections to allow the weakened sections to be resiliently deformed more easily than the base sections and the insulation stripping sections. The weakened sections are resiliently deformed upon the one or more insulated conductors engaging the insulation stripping sections of the insulation displacement arms as the one or more insulated conductors are inserted into the insulation stripping zone of the wire receiving slot, allowing the insulation displacement contact to accommodate the one or more insulated conductors of the same type and gauge chosen from a broad range of gauges.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
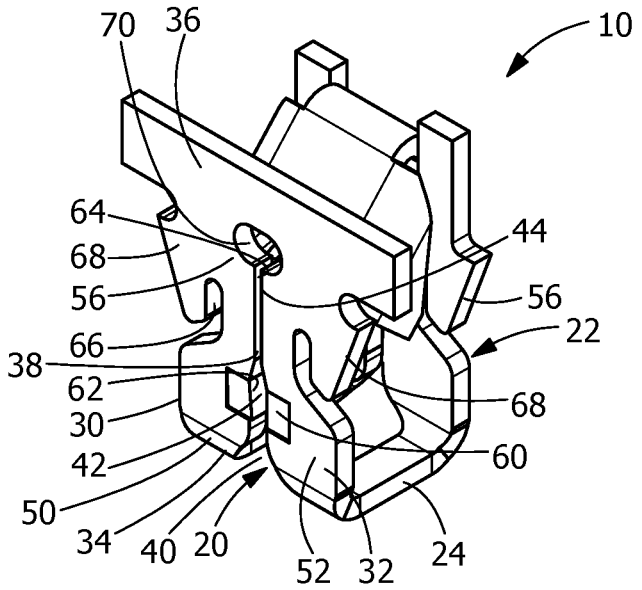
FIG. 1 is a top front perspective view of an insulation displacement contact according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
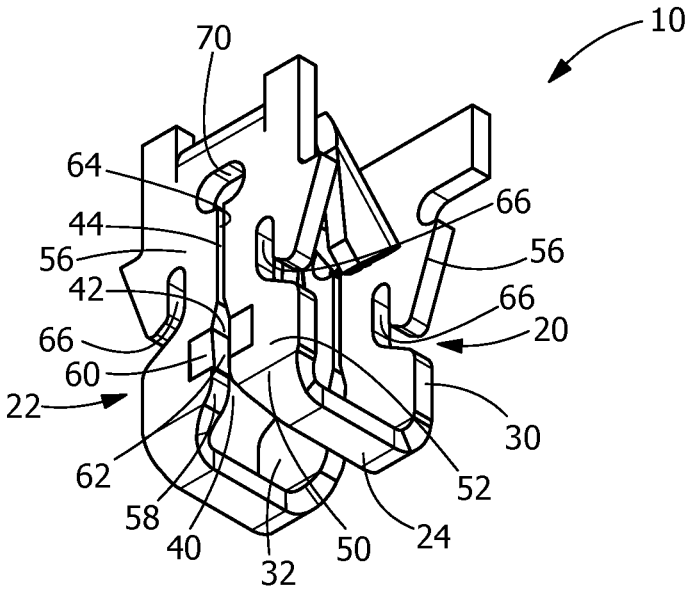
FIG. 2 is a bottom back perspective view of the insulation displacement contact of FIG. 1.
Figure 3:
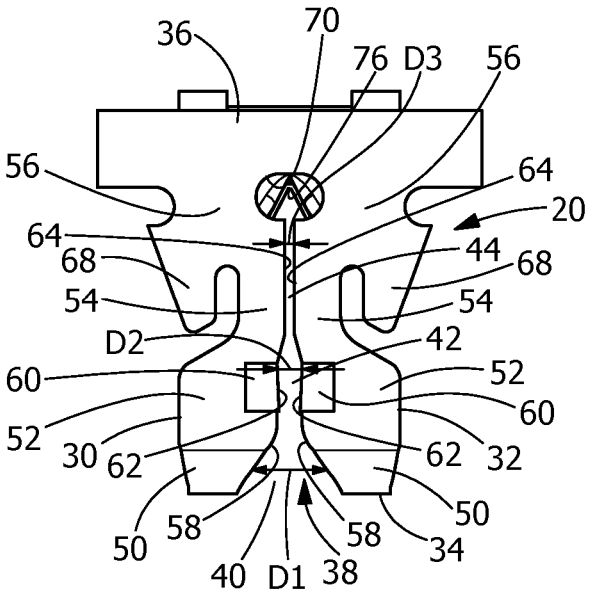
FIG. 3 is a front view of the insulation displacement contact of FIG. 1.

With reference to FIGS. 1 and 2, an illustrative insulation displacement contact 10. The insulation displacement contact 10 may be inserted into a contact receiving cavity of a housing (not shown).

Figure 12:
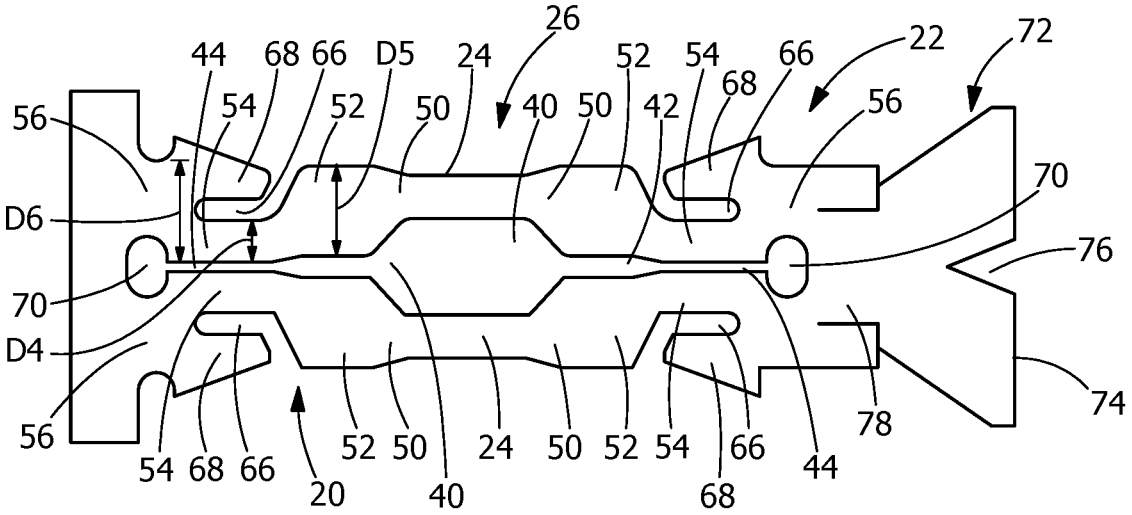
FIG. 12 is a blank of the insulation displacement contact which has been stamped but not formed.

As shown in FIGS. 1 through 5, each contact 10 has a first insulation displacement member 20 and a second insulation displacement member 22. The first insulation displacement member 20 is spaced from and is in line with the second insulation displacement member 22. As the second insulation displacement member 22 is essentially a mirror image of the first insulation displacement member 20, the first insulation displacement member 20 will be described in detail. However, the descriptions and numbers used to describe the first insulation displacement member 20 also apply to the second insulation displacement member 22. The first insulation displacement member 20 and the second insulation displacement member 22 are connected by base 24 which extends essentially perpendicular to the insulation displacement members 20, 22. The contact 10 is stamped from a sheet of conductive material to form a blank 26 as shown in FIG. 12. The blank 26 is the formed to the configuration shown in FIGS. 1 and 2.

The first insulation displacement member 20 has insulation displacement arms 30, 32 which are mirror images of each other. The insulation displacement arms 30, 32 extend from a free end 34 of the contact 10 to proximate a fixed end 36. The insulation displacement arms 30, 32 define a conductor or wire receiving slot 38. The wire receiving slot 38 is configured to receive one or more insulated conductors or wires 80, such as, but not limited to, magnet wires, therein.

The wire receiving slot 38 extends from the free end 34 of the contact 10 to proximate the fixed end 36. The wire receiving slot 38 has a wire lead in zone or section 40, an insulation stripping zone or section 42 and a wire termination zone or section 44. The wire lead in section 40 is positioned proximate the free end 34 and has width D1 which is greater than the width D2 of the insulation stripping section 42. The insulation stripping section 42 extends from the wire lead in section 40 to the wire termination section 44. The insulation stripping section 42 extends from the wire lead in area 40 to the wire termination section 44. The width D2 of the insulation stripping section 42 is greater than the width D3 of the wire termination section 44. The wire termination section 44 extends from the insulation stripping section 42 to proximate the free end 36. The width D1 of the wire lead in area 40 is greater than the width of the wire 80 to be inserted therein. The width D2 of the insulation stripping section 42 is less than the width of the wire 80 to be inserted therein, but essentially equal to or slightly larger than the width of the inner core 82 of the wire 80. The width D3 of the wire termination section 44 is less than the width of the inner core 82 of the wire. The core 80 can be a single wire or a plurality of wires combined to form a strand.

The insulation displacement arms 30, 32 have wire lead in sections 50, insulation stripping sections 52, weakened sections 54 and base sections 56. The wire lead in sections 50 are positioned proximate the free end 34. The wire lead in sections 50 have wire receiving surfaces 58 proximate the free end 34. The wire receiving surfaces 58 are sloped to form a substantially V-shaped configuration to facilitate an introduction or guide a conductor or wire into the wire receiving slot 38. The wire receiving surfaces 58 define the wire lead in section 40 of the wire receiving slot 38.

The insulation stripping sections 52 of the insulation displacement arms 30, 32 extend from the wire lead in sections 50 to the weakened sections 54. The insulation stripping sections 52 have stamped areas 60 which form cutting edges 62. The cutting edges 62 are configured to penetrate the insulation or coating which is provided on the wire. The cutting edges 62 define the insulation stripping section 42 of the wire receiving slot 38. In the illustrative embodiment shown, the length of the cutting edges 62 in the direction of insertion of the wires is greater than two times the diameter of a wire, thereby allowing two wires to be positioned between the cutting edges 62 at the same time. However, the length of the cutting edges 62 may vary without departing from the scope of the invention.

The weakened sections 54 of the insulation displacement arms 30, 32 extend from the insulation stripping sections 52 to the base 56. The weakened sections 54 have core engagement edges 64 which are configured to engage the core of the wire after the insulation or coating has been removed by the cutting edges 62 of the insulation stripping sections. The core engagement edges 64 extend from the weakened sections 54 to the base 56. The core engagement edges 64 define the wire termination section 44 of the wire receiving slot 38. In the illustrative embodiment shown, the length of the core engagement edges 64 in the direction of insertion of the wires is greater than two times the diameter of a wire, thereby allowing two wires to be positioned between the core engagement edges 64 at the same time. However, the length of the core engagement edges 64 may vary without departing from the scope of the invention.

The core engagement edges 64 do not have to be as sharp as the cutting edges 62 of the insulation stripping sections. In various embodiments, the core engagement edges 64 have a rounded or even flat shape to provide a greater contact area between the core engagement edges 64 of the weakened sections 54 with the core of the wire.

As shown in FIG. 12, when stamped, the weakened sections 54 of the insulation displacement arms 30, 32 has relief slots 66 stamped from the sides thereof opposite the wire receiving slot 38, thereby reducing the width of the weakened sections 54. The weakened sections 54 are, therefore, configured to have a width D4 (FIG. 12) which is less than the width D5 (FIG. 12) of the insulation stripping sections 52 and less than the width D6 (FIG. 12) of the base 56. The reduced width of the weakened sections 54 allows the weakened sections 54 to be resiliently deformed more easily than the base 56 and the insulation stripping sections 52, as will be more fully described.

The base 56 has securing projections 68 which engage walls of the contact receiving cavity of the housing (not shown). The projections 68 are configured to displace material of the housing to retain the insulation displacement contact 10 in the housing. The insulation displacement contact 10 may secured in the housing by other methods or devices without departing from the scope of the invention. An opening 70 is provided in the base 56 at the end of the wire receiving slot 38. The opening 70 is provided to facilitate the control movement of the insulation displacement arms 30, 32 relative to each other.

Figure 4:
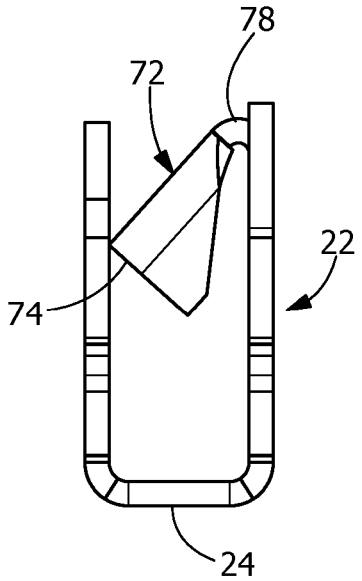
FIG. 4 is a side view of the insulation displacement contact of FIG. 1.
Figure 5:
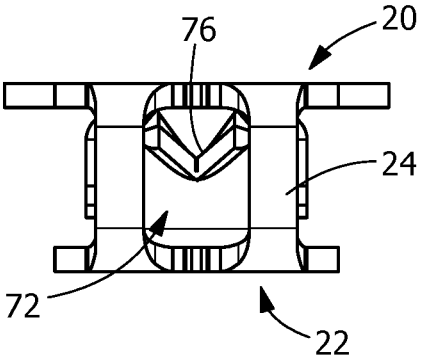
FIG. 5 is a bottom view of the insulation displacement contact of FIG. 1.

A stabilization member 72 extends from the second insulation displacement member 22. The stabilization member 72 has a free end 74 and a mounting end 78. As best shown in FIG. 4, the mounting end 78 is attached to the second insulation displacement member 22 and is bent such that the free end 74 may positioned proximate to or engage the first insulation displacement member 20. The stabilization member 72 is configured to maintain the proper spacing between the second insulation displacement member 22 and the first insulation displacement member 20. The stabilization member 72 also supports both the second insulation displacement member 22 and the first insulation displacement member 20, to prevent the unwanted movement of the second insulation displacement member 22 and the first insulation displacement member 20 inward toward each other. The stabilization member 72 is formed to have a V-shaped slot or groove 76 to prevent the stabilization member 72 from interfering with a wire or wires which are terminated to the terminal 10.

Figure 6:
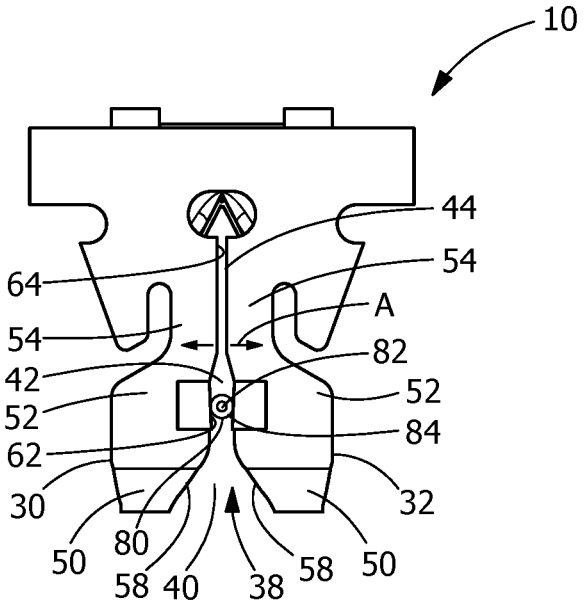
FIG. 6 is a partial front view of the insulation displacement contact with a thin or large gauge number initially inserted into the slot of the contact.
Figure 7:
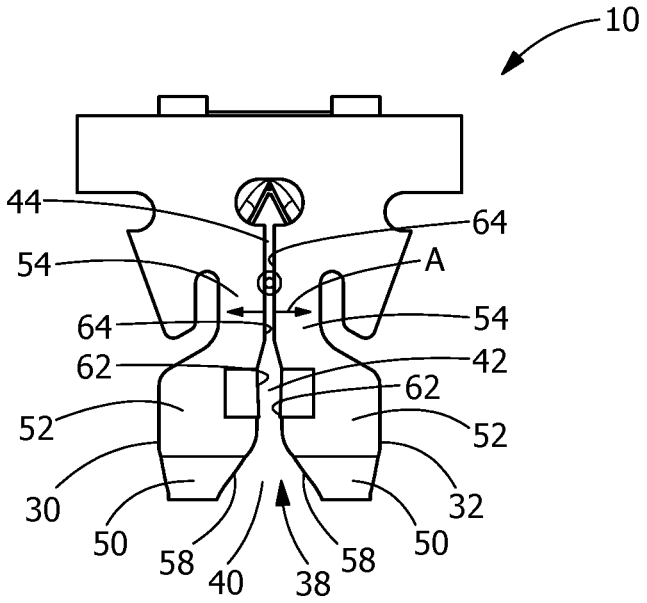
FIG. 7 is a partial front view of the insulation displacement contact with the thin or large gauge number fully inserted into the slot of the contact.

Referring to FIGS. 6 and 7, a wire 80 of a small diameter or high gauge, for example a 30 AWG wire is brought into engagement with the insulation displacement contact 10. As this occurs, the wire 80 is positioned in the wire receiving slot 38. As the wire 80 is moved relative to the insulation displacement contact 10 or as the insulation displacement contact 10 is moved relative to the wire 80, the wire 80 enters the wire lead in section 40 of the wire receiving slot 38 and engages the wire receiving surfaces 58 of the wire lead in sections 50 of the insulation displacement arms 30, 32. With continued insertion the wire 80 is moved by the wire receiving surfaces 58 of the wire lead in sections 50 of the insulation displacement arms 30, 32 into alignment with the insulation stripping section 42 of the wire receiving slot 38.

The continued insertion of the wire 80 into the wire receiving slot 38 causes the wire 80 to move into the insulation stripping section 42 of the wire receiving slot 38. As this occurs, the insulation or protective coating 84 of the wire 80 engages the cutting edges 62 of the insulation stripping sections 52 of the of the insulation displacement arms 30, 32. As the width D2 of the insulation stripping section 42 is less than the width of the wire 80 to be inserted therein, but essentially equal to the width of the inner core 82 of the wire 80, the cutting edges 62 of the insulation stripping sections 52 will cut, remove or strip the insulation or protective coating 84 of the wire 80 to expose the core 82 in that region. As the wire 80 is of a small diameter or high gauge, the weakened sections 54 of the insulation displacement arms 30, 32 are moved only a small distance in the directions of arrows A in FIG. 6.

The continued insertion of the wire 80 into the wire receiving slot 38 causes the wire 80 to move into the wire termination section 44 of the wire receiving slot 38. As this occurs, the inner core 82 which was exposed in the insulation stripping sections 52 of the of the insulation displacement arms 30, 32 mechanically and electrically engages the core engagement edges 64 of the weakened sections 54 of the insulation displacement arms 30, 32. As the width D3 of the wire termination section 44 is less than the width of the inner core 82 of the wire 80, the core engagement edges 64 of the weakened sections 54 will frictionally engage the core 82 in that region. As the wire 80 is of a small diameter or high gauge, the weakened sections 54 of the insulation displacement arms 30, 32 are moved only a small distance in the directions of arrows A in FIG. 7.

Figure 8:
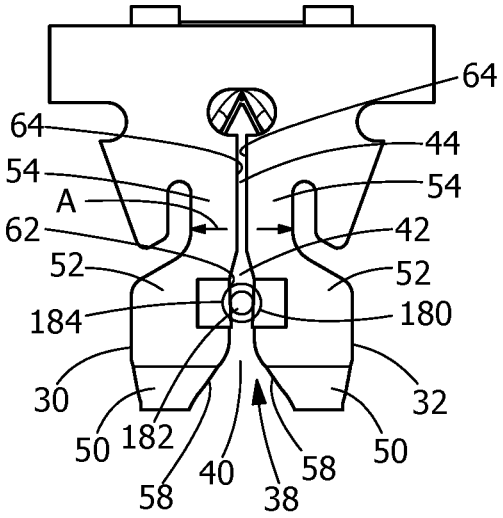
FIG. 8 is a partial front view of the insulation displacement contact with a thick or small gauge number initially inserted into the slot of the contact.
Figure 9:
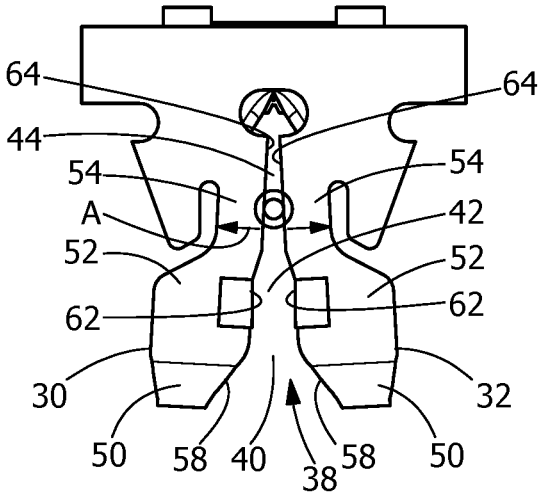
FIG. 9 is a partial front view of the insulation displacement contact with the thick or small gauge number fully inserted into the slot of the contact.

Referring to FIGS. 8 and 9, a wire 180 of a large diameter or low gauge, for example a 25 AWG wire is brought into engagement with the insulation displacement contact 10. As this occurs, the wire 180 is positioned in the wire receiving slot 38. As the wire 180 is moved relative to the insulation displacement contact 10 or as the insulation displacement contact 10 is moved relative to the wire 180, the wire 180 enters the wire lead in section 40 of the wire receiving slot 38 and engages the wire receiving surfaces 58 of the wire lead in sections 50 of the insulation displacement arms 30, 32. With continued insertion the wire 180 is moved by the wire receiving surfaces 58 of the wire lead in sections 50 of the insulation displacement arms 30, 32 into alignment with the insulation stripping section 42 of the wire receiving slot 38.

The continued insertion of the wire 180 into the wire receiving slot 38 causes the wire 180 to move into the insulation stripping section 42 of the wire receiving slot 38. As this occurs, the insulation or protective coating 184 of the wire 180 engages the cutting edges 62 of the insulation stripping sections 52 of the of the insulation displacement arms 30, 32. As the width D2 of the insulation stripping section 42 is less than the width of the wire 180 to be inserted therein, and less than the width of the inner core 182 of the wire 180, the cutting edges 62 of the insulation stripping sections 52 will cut, remove or strip the insulation or protective coating 184 of the wire 180 to expose the core 182 in that region. As shown in FIG. 8, as the wire 180 is of a large diameter or low gauge, the weakened sections 54 of the insulation displacement arms 30, 32 is moved a greater distance in the directions of arrows A than shown in FIG. 6. As the weakened portions 54 have a reduced width D4 (FIG. 12) which is less than the width D6 (FIG. 12) of the base 56, the weakened portions 54 are resiliently deformed as the wire 180 is inserted. The configuration of the weakened portions 54 allow the insulation displacement arms 30, 32 to move without taking a permanent set, thereby allowing the insulation displacement arms 30, 32 to exert the desired normal forces on the wire 180 as it is terminated to the insulation displacement contact 10.

The continued insertion of the wire 180 into the wire receiving slot 38 causes the wire 180 to move into the wire termination section 44 of the wire receiving slot 38. As this occurs, the inner core 182 which was exposed in the insulation stripping sections 52 of the insulation displacement arms 30, 32 mechanically and electrically engages the core engagement edges 64 of the weakened sections 54 of the insulation displacement arms 30, 32. As the width D3 of the wire termination section 44 is less than the width of the inner core 182 of the wire 180, the core engagement edges 64 of the weakened sections 54 will frictionally engage and compress the core 182 in that region. As the wire 180 is of a large diameter or small gauge, the weakened sections 54 of the insulation displacement arms 30, 32 is moved a greater distance in the directions of arrows A (FIG. 9) than shown in FIG. 7. As the weakened portions 54 have a reduced width D4 (FIG. 12) which is less than the width D6 (FIG. 12) of the base 56, the weakened portions 54 are resiliently deformed as the wire 180 is inserted. The configuration of the weakened portions 54 allow the insulation displacement arms 30, 32 to move without taking a permanent set, thereby allowing the insulation displacement arms 30, 32 to exert the desired normal forces on the wire 180 as it is terminated to the insulation displacement contact 10.

Figure 10:
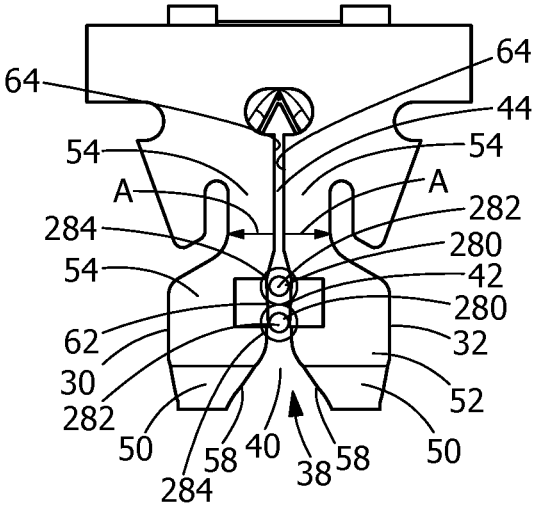
FIG. 10 is a partial front view of the insulation displacement contact with two thick or small gauge number initially inserted into the slot of the contact.
Figure 11:
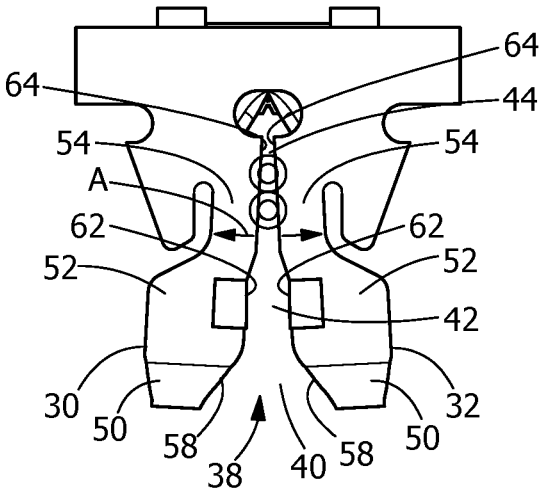
FIG. 11 is a partial front view of the insulation displacement contact with two thick or small gauge number fully inserted into the slot of the contact.

Referring to FIGS. 10 and 11, two wires 280 of a large diameter or small gauge, for example a 26 AWG wire is brought into engagement with the insulation displacement contact 10. As this occurs, the wires 280 are positioned in the wire receiving slot 38. As the wires 280 are moved relative to the insulation displacement contact 10 or as the insulation displacement contact 10 is moved relative to the wires 280, the wires 280 enter the wire lead in section 40 of the wire receiving slot 38 and engages the wire receiving surfaces 58 of the wire lead in sections 50 of the insulation displacement arms 30, 32. With continued insertion, the wires 280 are moved by the wire receiving surfaces 58 of the wire lead in sections 50 of the insulation displacement arms 30, 32 into alignment with the insulation stripping section 42 of the wire receiving slot 38.

The continued insertion of the wires 280 into the wire receiving slot 38 causes the wire 280 to move into the insulation stripping section 42 of the wire receiving slot 38. As this occurs, the insulation or protective coating 84 of the wire 280 engage the cutting edges 62 of the insulation stripping sections 52 of the of the insulation displacement arms 30, 32. As the width D2 of the insulation stripping section 42 is less than the width of the wires 280 to be inserted therein, and less than the width of the inner cores 282 of the wires 280, the cutting edges 62 of the insulation stripping sections 52 will cut, remove or strip the insulation or protective coating 284 of the wires 280 to expose the cores 282 in that region. As shown in FIG. 10, as the wires 280 are of a large diameter or low gauge, the weakened sections 54 of the insulation displacement arms 30, 32 are moved a greater distance in the directions of arrows A than shown in FIG. 6. As the weakened portions 54 have a reduced width D4 (FIG. 12) which is less than the width D6 (FIG. 12) of the base 56, the weakened portions 54 are resiliently deformed as the wires 280 are inserted. The configuration of the weakened portions 54 allow the insulation displacement arms 30, 32 to move without taking a permanent set, thereby allowing the insulation displacement arms 30, 32 to exert the desired normal forces on the wires 280 as they are terminated to the insulation displacement contact 10.

The continued insertion of the wires 280 into the wire receiving slot 38 causes the wires 280 to move into the wire termination section 44 of the wire receiving slot 38. As this occurs, the inner cores 282 which was exposed in the insulation stripping sections 52 of the of the insulation displacement arms 30, 32 mechanically and electrically engage the core engagement edges 64 of the weakened sections 54 of the insulation displacement arms 30, 32. As the width D3 of the wire termination section 44 is less than the width of the inner cores 282 of the wires 280, the core engagement edges 64 of the weakened sections 54 will frictionally engage and compress the cores 282 in that region. As the wires 280 are of a large diameter or small gauge, the weakened sections 54 of the insulation displacement arms 30, 32 is moved a greater distance in the directions of arrows A (FIG. 11) than shown in FIG. 7. As the weakened portions 54 have a reduced width D4 (FIG. 12) which is less than the width D6 (FIG. 12) of the base 56, the weakened portions 54 are resiliently deformed as the wire 180 is inserted. The configuration of the weakened portions 54 allow the insulation displacement arms 30, 32 to move without taking a permanent set, thereby allowing the insulation displacement arms 30, 32 to exert the desired normal forces on the wires 280 as they are terminated to the insulation displacement contact 10.

The insulation displacement contact 10 of the present invention allows for the termination of more than one wire or magnet wire therein and accommodates wires or magnet wires of different sizes of gauges, thereby eliminating the need for different part and part numbers for wires of different sizes of gauges.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An insulation displacement contact comprising:

insulation displacement arms which define a conductor or wire receiving slot, the insulation displacement arms having insulation stripping sections, weakened sections and base sections, the insulation stripping sections having stamped areas which form cutting edges, the cutting edges define the insulation stripping zone of the wire receiving slot, the weakened sections having weakened section widths which are less than insulation stripping section widths of the insulation stripping sections and less than base section widths of the base section, an opening provided in the base section at the end of the wire receiving slot;

the wire receiving slot is configured to receive one or more insulated conductors therein, the wire receiving slot having an insulation stripping zone and a wire termination zone, the insulation stripping zone being adjacent to the insulation stripping sections of the insulation displacement arms, the wire termination zone being adjacent to the weakened sections of the insulation displacement arms, the insulation stripping zone width of the insulation stripping zone is greater than the wire termination zone width of the wire termination zone;

wherein the weakened sections are resiliently deformed upon the one or more insulated conductors engaging the insulation stripping sections of the insulation displacement arms as the one or more insulated conductors are inserted into the insulation stripping zone of the wire receiving slot;

wherein the opening allows for the control movement of the insulation displacement arms relative and independent to each other.

2. The insulation displacement contact as recited in claim 1, wherein a first insulation displacement member having two insulation displacement arms is spaced from and positioned in line with a second insulation displacement member having two insulation displacement arms.

3. The insulation displacement contact as recited in claim 2, wherein a stabilization member extends from the second insulation displacement member, the stabilization member has a free end and a mounting end, the mounting end is attached to the second insulation displacement member and bent to position the free end proximate to the first insulation displacement member.

4. The insulation displacement contact as recited in claim 3, wherein the stabilization member has a V-shaped slot.

5. The insulation displacement contact as recited in claim 1, wherein the wire receiving slot extends from a free end of the contact to proximate a fixed end, the wire receiving slot has a wire lead in zone positioned proximate the free end, the insulation stripping zone extends from the wire lead in zone to the wire termination zone.

6. The insulation displacement contact as recited in claim 5, wherein the insulation displacement arms have wire lead in sections with wire receiving surfaces proximate the free end, the wire receiving surfaces are sloped to form a substantially V-shaped configuration, the wire receiving surfaces define the wire lead in zone of the wire receiving slot.

7. The insulation displacement contact as recited in claim 1, wherein the insulation stripping sections of the insulation displacement arms extend from wire lead in sections of the insulation displacement arms to the weakened sections.

8. The insulation displacement contact as recited in claim 7, wherein the cutting edges in the direction of insertion of the one or more insulated conductors is greater than two times the diameter of one of the insulated conductors of the one or more insulated conductors wire.

9. The insulation displacement contact as recited in claim 1, wherein the weakened sections of the insulation displacement arms extend from the insulation stripping sections to the base sections, the weakened sections have core engagement edges, the core engagement edges define the wire termination zone of the wire receiving slot.

10. The insulation displacement contact as recited in claim 1, wherein slots are provided proximate the weakened sections of the insulation displacement arms, the slots extend from sides of the weakened sections which are opposite the wire receiving slot.

11. The insulation displacement contact as recited in claim 1, wherein an opening is provided in the base section at the end of the wire receiving slot.

12. An insulation displacement contact comprising:

insulation displacement arms define a conductor or wire receiving slot, the insulation displacement arms having insulation stripping sections, weakened sections and base sections, the insulation stripping sections having stamped areas which form cutting edges, an opening provided in the base section at the end of the wire receiving slot;

the wire receiving slot is-configured to receive one or more insulated conductors therein, the wire receiving slot having an insulation stripping zone and a wire termination zone, the insulation stripping zone being adjacent to the insulation stripping sections of the insulation displacement arms, the wire termination zone being adjacent to the weakened sections of the insulation displacement arms;

relief slots are provided proximate the weakened sections of the insulation displacement arms, the slots extend from sides of the weakened sections which are opposite the wire receiving slot, the relief slots reduce a width of the weakened sections to allow the weakened sections to be resiliently deformed more easily than the base sections and the insulation stripping sections;

wherein the weakened sections are resiliently deformed upon the one or more insulated conductors engaging the insulation stripping sections of the insulation displacement arms as the one or more insulated conductors are inserted into the insulation stripping zone of the wire receiving slot;

wherein the opening allows for the control movement of the insulation displacement arms relative and independent to each other.

13. The insulation displacement contact as recited in claim 12, wherein a first insulation displacement member having two insulation displacement arms is spaced from and position in line with a second insulation displacement member having two insulation displacement arms.

14. The insulation displacement contact as recited in claim 13, wherein a stabilization member extends from the second insulation displacement member, the stabilization member has a free end and a mounting end, the mounting end is attached to the second insulation displacement member and bent to position the free end proximate to the first insulation displacement member.

15. The insulation displacement contact as recited in claim 14, wherein the stabilization member has a V-shaped slot.

16. The insulation displacement contact as recited in claim 12, wherein the wire receiving slot extends from a free end of the contact to proximate the fixed end, the wire receiving slot has a wire lead in zone positioned proximate the free end, the insulation stripping zone extends from the wire lead in zone to the wire termination zone.

17. The insulation displacement contact as recited in claim 16, wherein the insulation displacement arms have wire lead in sections with wire receiving surfaces proximate the free end, the wire receiving surfaces are sloped to form a substantially V-shaped configuration, the wire receiving surfaces define the wire lead in zone of the wire receiving slot.

18. The insulation displacement contact as recited in claim 12, wherein the insulation stripping sections of the insulation displacement arms extend from wire lead in sections of the insulation displacement arms to the weakened sections, the cutting edges define the insulation stripping zone of the wire receiving slot.

19. The insulation displacement contact as recited in claim 18, wherein the cutting edges in the direction of insertion of the one or more insulated conductors is greater than two times the diameter of one of the insulated conductors of the one or more insulated conductors wire.

20. The insulation displacement contact as recited in claim 12, wherein the weakened sections of the insulation displacement arms extend from the insulation stripping sections to the base sections, the weakened sections have core engagement edges, the core engagement edges define the wire termination zone of the wire receiving slot.

* * * * *